US005389856A

United States Patent [19]

Luijks et al.

[11] Patent Number: 5,389,856

[45] Date of Patent: Feb. 14, 1995

[54] HIGH-PRESSURE DISCHARGE LAMP WITH AN INTEGRAL FUSE-CAPACITOR COMPONENT

[75] Inventors: Gerardus M. J. F. Luijks; Hubertus A. M. Coenen, both of Eindhoven, Netherlands

[73] Assignee: U.S. Philips Corporation, New York, N.Y.

[21] Appl. No.: 2,007

[22] Filed: Jan. 8, 1993

[30] Foreign Application Priority Data

Jan. 17, 1992 [EP] European Pat. Off. ..... 92200125.0

[51] Int. Cl.[6] ..... H01J 7/44

[52] U.S. Cl. ..... 315/58; 315/59; 315/46; 315/73; 315/290

[58] Field of Search ..... 315/58, 59, 53, 73, 315/46, 290

[56] References Cited

U.S. PATENT DOCUMENTS 5,053,676 10/1991 Luijks et al. ..... 315/58

5,138,231 8/1992 Iida et al. ..... 315/59 X

*Primary Examiner*—Robert J. Pascal

*Assistant Examiner*—Haissa Philogene

*Attorney, Agent, or Firm*—Brian J. Weighaus

[57] ABSTRACT

The invention relates to a high-pressure discharge lamp (2) provided with a discharge vessel (3) and an outer envelope (30) which encloses a space (6). The lamp is provided with an igniter circuit (10) which comprises a voltage-dependent capacitor (8) and a fuse (7). According to the invention, the voltage-dependent capacitor and the fuse (7) are integrated so as to form a single component (18).

21 Claims, 1 Drawing Sheet

HIGH-PRESSURE DISCHARGE LAMP WITH AN INTEGRAL FUSE-CAPACITOR COMPONENT

BACKGROUND OF THE INVENTION

The invention relates to a high-pressure discharge lamp provided with a discharge vessel which is enclosed with intervening space by an outer envelope and which is provided with electrodes between which a discharge extends in the operational condition of the lamp, while each electrode is connected to a relevant current supply conductor, and provided with an igniter circuit which comprises a voltage-dependent capacitor and a fuse.

A lamp of the kind mentioned in the opening paragraph is known from EP-A-0431 696. In the known lamp, which is suitable for operation in series with a stabilizer ballast on an AC voltage supply source, the capacitor is arranged in the outer envelope. In the known lamp, the fuse is included in the electrical connection between the voltage-dependent capacitor and the current supply conductors. It is achieved by this that an overload on the stabilizer ballast owing to excessively high currents is prevented through melting of the fuse even under unfavourable conditions such as a short-circuit in the capacitor.

It is attractive to arrange the capacitor in the outer envelope because of a comparatively simple lamp manufacturing method, inter alia because there is comparatively much space available there, in contrast to, for example, the lamp cap.

A disadvantage of the known lamp is the use of at least one additional component in the form of the fuse in the igniter circuit. This raises the manufacturing cost both on account of a higher complexity of the manufacture and on account of a rise in the reject percentage during manufacture. A further disadvantage is that the use of the additional component seriously hampers an automation of lamp manufacture. This accordingly leads to a more expensive manufacturing method for the lamp.

SUMMARY OF THE INVENTION

The invention has for its object inter alia to provide a measure for counteracting the described disadvantage, while the igniter circuit is still mounted in the outer envelope.

According to the invention, this object is realised in a lamp of the kind mentioned in the opening paragraph in that the lamp is characterized in that the voltage-dependent capacitor and the fuse are integrated so as to form a single component.

The use of an integral component reduces the number of components to be mounted, which implies a simplification of lamp manufacture. This also enhances the possibility of manufacturing by automatic mounting. The integration in addition achieves that the overall dimensions of the combined capacitor and fuse are reduced, which again results in a simpler lamp manufacture.

The integral component may be constructed in the shape of a plate or of a disc. In an advantageous embodiment, the fuse is provided at one side of the component constructed as a plate or disc, on an insulating base surface, for example by film technology.

Thermal screening of the capacitor is achieved in a simple manner in that the integral component thus formed is mounted with its side comprising the fuse facing the discharge vessel. Infrared radiation from the discharge vessel leads to strong heating of the starter circuit components, especially in the case of an evacuated outer envelope.

To counteract any risk of electric breakdown (so-called corona discharge) across the integral component and of reduction and evaporation of the integral component, the latter may be mounted in a gas-filled ambience, preferably in a gas-filled gastight glass capsule. It is conceivable to fill the outer envelope itself with a suitable gas instead of using a separate capsule. An equivalent protection against the risk of corona discharge and against dissociation and/or evaporation of the integral component can be achieved by this. Owing to convection and conduction in the gas present in the outer bulb, heating of the integral component can be considerably reduced. The said convection and conduction lead to thermal losses and thus adversely affect the luminous efficacy of the lamp. For a large number of types of high-pressure discharge lamps, therefore, this is not a suitable solution.

Gas composition is so chosen that no corona discharge or reactions with components of the capacitor take place during lamp operation under the prevailing conditions. Suitable gases are $SF_6$, nitrogen, oxygen, and to a lesser degree rare gases. The gas filling may be formed by a single gas. Combinations of gases, however, are also possible.

A further advantage of the invention is that the use of the gas-filled gaslight glass capsule for mounting the integral component renders the measure according to the invention generally applicable to high-pressure discharge lamps.

A further improvement of the lamp can be achieved in that the gastight glass capsule is provided with a radiation-reflecting layer. It is achieved by this in a simple but effective way that heating of the integral component, and thus of the capacitor in the operational condition of the lamp is considerably reduced. A further minimization of radiation on the integral component can be achieved in that the component is so positioned that the longitudinal axis of the discharge vessel lies substantially in a common plane with the component, which generally has the shape of a plate or disc.

In a further embodiment of the lamp according to the invention, a voltage-dependent resistor is included in series with the capacitor. An advantage of this is on the one hand that the moment at which an ignition voltage pulse is generated can be favourably chosen through a suitable choice of the current-voltage characteristic of the resistor. On the other hand, the resistance character of the voltage-dependent resistor ensures that the level of the generated ignition voltage pulse is limited. If so desired, the resistor may be integrated with the single component.

A further improvement of the electrical properties of the igniter circuit is possible in that the igniter circuit also comprises a bimetal switch in the electrical connection between the single component and the current supply conductors. Heat generated by the lamp after ignition ensures in this case that the bimetal switch opens, so that the electrical connection is broken and the operation of the igniter circuit is thus ended. Breaking of the electrical connection by the bimetal switch involves a risk of residual charge remaining on the capacitor. Without further precautions, this will lead to internal degeneration of the capacitor, resulting in short-circuit through the capacitor. The comparatively high temperature at which the capacitor is in the operational condition of the lamp plays a detrimental part here. To prevent this, a comparatively high-ohmic resistor is included in the igniter circuit. By maintaining the direct electrical connection through the resistor in the operational condition of the lamp, it is achieved that any residual charge on the voltage-dependent capacitor can flow away through the discharge between the electrodes and/or through the supply source. Preferably, the high-ohmic resistor is integrated with the single component. It may be desirable for an ohmic impedance to be present parallel to the voltage-dependent capacitor also under conditions other than the operational condition of the lamp. The use of a single component according to the present invention is favourable in that case.

The lamp according to the invention is particularly suitable as a replacement for a high-pressure mercury lamp. To improve the ignition behaviour of the lamp, the discharge vessel may be provided with an external ignition antenna which rests mainly against the discharge vessel at least in the non-operational condition of the lamp. The igniter circuit of the lamp according to the invention may also be provided with a voltage-dependent breakdown element such as, for example, a SIDAC.

BRIEF DESCRIPTION OF THE DRAWINGS This and other aspects of the invention will be explained in more detail and described with reference to a drawing of an embodiment, in which FIG. 1 shows a lamp in elevation, FIG. 2 is a diagram of a circuit formed by the lamp of FIG. 1 together with a stabilizer ballast, and FIG. 3 is a diagram of a circuit formed by the lamp of FIG. 1 provided with a modified version of the igniter system.

DESCRIPTION OF THE PREFERRED EMBODIMENTS

Figure 1:
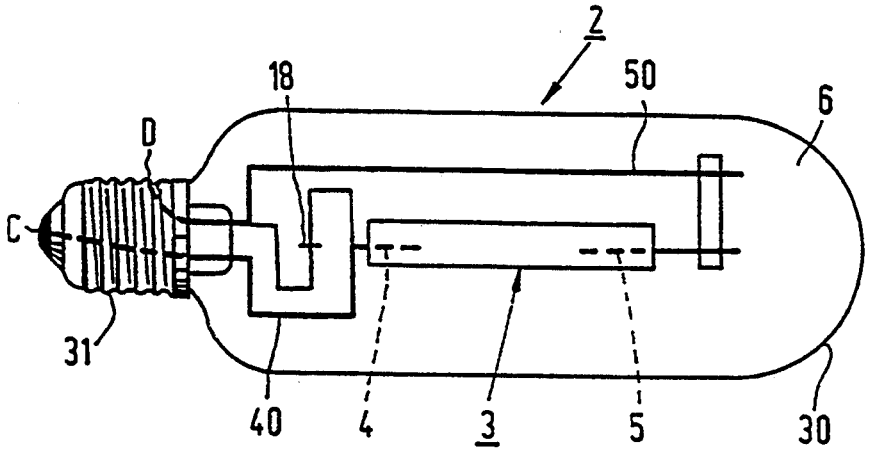

FIG. 1 shows a lamp 2 according to the invention provided with a discharge vessel 3 which is surrounded by an outer envelope 30 which encloses an evacuated space 6 and is fitted with a lamp cap 31, and provided with an igniter circuit in which a voltage-dependent capacitor integrated with a fuse into a single component 18 is accommodated. The integral component 18 is mounted in the evacuated space 6 enclosed by the outer envelope 30. The discharge vessel 3 is provided with electrodes 4 and 5 between which a discharge extends in the operational condition of the lamp. Each electrode 4, 5 is connected to a respective rigid current supply conductor 40, 50. Current supply conductor 40 is connected to a lamp connection point C of lamp cap 31. Similarly, current supply conductor 50 is connected to a lamp connection point D of lamp cap 31. The integral component 18 is mounted between the current supply conductors 40 and 50 with direct electrical contact.

Figure 2:
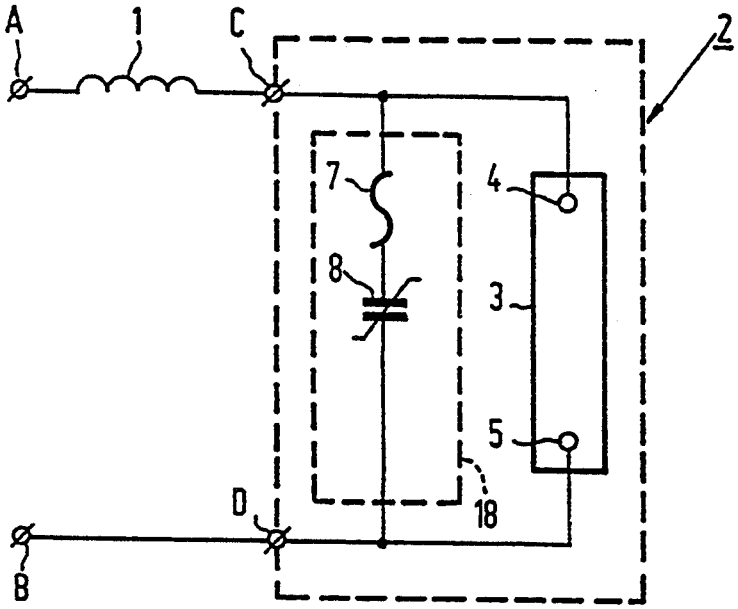

In FIG. 2, parts corresponding to those in FIG. 1 are given corresponding reference numerals. A and B are connection points for an AC voltage supply source. Connection point A is connected to lamp connection point C via a stabilizer ballast 1. Connection point B is connected to lamp connection point D. The igniter circuit comprising the single component 18 consisting of fuse 7 and voltage-dependent capacitor 8 together with the stabilizer ballast 1 generates ignition voltage pulses between the lamp connection points C and D, and thus between the lamp electrodes 4 and 5, in a known manner.

The discharge vessel 3 may be provided with an external auxiliary electrode as a further ignition aid.

A practical embodiment of a lamp according to the invention which may be used is a high-pressure sodium discharge lamp with a power rating of 110W and an evacuated outer envelope. The lamp may be operated with a stabilizer ballast type BHL125L, make Philips, on a supply voltage source of 220V, 50 Hz. The discharge vessel is preferably provided with an external auxiliary electrode.

A fusion current value of 0.5A is a very suitable one for the fuse 7. A suitable voltage-dependent capacitor for the igniter circuit is a TDK-brand capacitor. According to the invention, the capacitor is integrated with the fuse 7 so as to form a single component, for example, in that the fuse is provided by film technology on an insulating base layer at one side of the integral component. The said TDK-brand capacitor has a constant capacitance value of approximately 2 nF at temperatures above a limit temperature of 90° C. The plate-shaped capacitor has dimensions of 17 mm×9 mm×0.7 mm.

Upon connection to the 220V, 50 Hz supply source, an igniter circuit thus constructed generates an ignition voltage pulse of approximately 1000V approximately 1 ms after each zero crossing of the supply voltage. The lamp can ignite quickly and reliably as a result.

The temperature of the voltage-dependent capacitor will be between 150° C. and 200° C., so above the limit value, when the lamp is in the operational condition. The capacitance value is then independent of the voltage at 2 nF, so that pulse generation is effectively suppressed.

Figure 3:
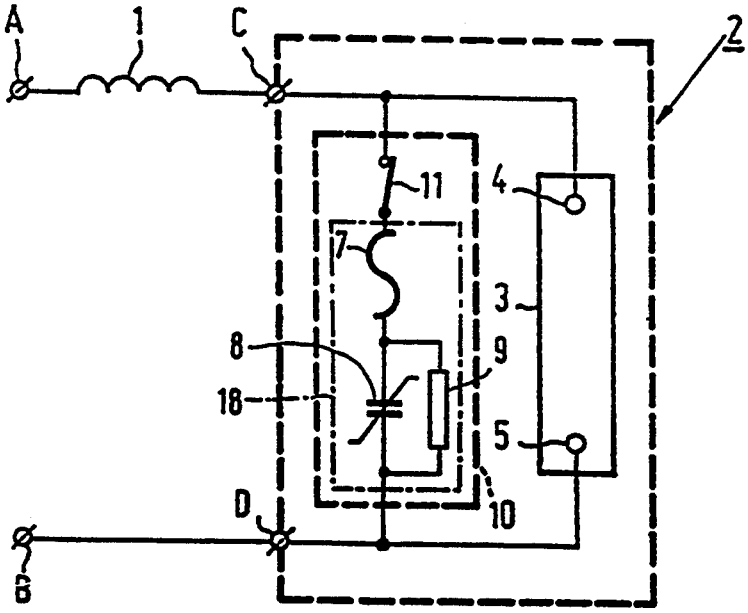

In FIG. 3, parts corresponding to those in FIG. 1 are given corresponding reference numerals. The igniter circuit 10 is also provided with a resistor 9 and a bimetal switch 11. The integral component 18 is built up from a voltage-dependent capacitor 8, fuse 7 and a high-ohmic resistor 9. In the igniter circuit 10, the chain comprising bimetal switch 11, fuse 7, and voltage-dependent capacitor 8 together with the stabilizer ballast 1 generates ignition voltage pulses between the lamp connection points C and D, and thus between the lamp electrodes 4 and 5, in a known manner. When the lamp has ignited, the bimetal switch 11 will open owing to heat generation, so that further ignition pulse generation is effectively stopped. Any residual charge on the voltage-dependent capacitor can be drained off through resistor 9 to connection point B.

The discharge vessel 3 may be provided with an external auxiliary electrode as a further ignition aid.

For a practical lamp of the high-pressure sodium discharge type with a power rating of 110V and an evacuated outer envelope, the fuse has a fusion current value of 0.5A and the resistor 9 has a value of 1 Mohm.

A resistor of this value which in the operational condition of the lamp is capable of assuming a temperature of more than 200° C. is eminently suitable for being manufactured in the form of a ceramic resistor on an insulating base layer by thick film technology. Preferably, this resistor together with the fuse is integrated with a voltage-dependent capacitor, make TDK, for example of the NLB 1250 type, so as to form a single component.

The igniter circuit described is capable of generating ingition voltage pulses of approximately 1000V, sufficient for igniting a high-pressure sodium discharge lamp quickly and reliably.

We claim:

1. A high pressure discharge lamp, comprising:
a) an outer envelope;
b) a discharge vessel arranged with said outer envelope and energizeable for emitting light; and
c) an ignitor circuit arranged within said outer envelope for igniting said discharge vessel, said ignitor circuit including an integral component comprising a capacitor and a fuse non-separably and directly joined to each other.

2. A lamp as claimed in claim 1, further comprising a gas-filled gastight glass capsule in which said integral component is mounted.

3. A lamp as claimed in claim 2, characterized in that the said integral component is constructed as a planar body having an insulating base layer, and said fuse comprises a metallic film disposed on said insulating base layer.

4. A lamp as claimed in claim 3, characterized in that said igniter circuit includes a bimetal switch.

5. A lamp as claimed in claim 4, characterized in that said igniter circuit includes with a resistor.

6. A lamp as claimed in claim 5, characterized in that said integral component further includes a resistor nonseparably and directly joined therewith.

7. A lamp as claimed in claim 3, characterized in that said igniter circuit includes a resistor.

8. A lamp as claimed in claim 7, characterized in that said integral component further includes a resistor nonseparably and directly joined therewith.

9. A lamp as claimed in claim 2, characterized in that said igniter circuit includes a resistor.

10. A lamp as claimed in claim 9, characterized in that said integral component further includes a resistor nonseparably and directly joined therewith.

11. A lamp as claimed in claim 1, characterized in that said igniter circuit includes a resistor.

12. A lamp as claimed in claim 1, characterized in that said integral component further includes a resistor nonseparably and directly joined therewith.

13. A lamp as claimed in claim 2, characterized in that said igniter circuit includes a bimetal switch.

14. A lamp as claimed in claim 13, characterized in that said igniter circuit includes a resistor.

15. A lamp as claimed in claim 1, characterized in that said igniter circuit includes a bimetal switch.

16. A lamp as claimed in claim 15, characterized in that said igniter circuit includes a resistor.

17. A lamp as claimed in claim 1, characterized in that said integral component is constructed as a planar body having an insulating base layer, and said fuse comprises a metallic film disposed thereon.

18. A lamp as claimed in claim 17, characterized in that said igniter circuit includes a bimetal switch.

19. A lamp as claimed in claim 18, characterized in that said igniter circuit includes a resistor.

20. A lamp as claimed in claim 19, characterized in that said integral component further includes a resistor nonseparably and directly joined therewith.

21. A high pressure discharge lamp, comprising:
a) an outer envelope;
b) a discharge vessel arranged with said outer envelope and energizeable for emitting light; and
c) an ignitor circuit arranged within said outer envelope for igniting said discharge vessel, said ignitor circuit including a sealed capsule and an integral component enclosed in said sealed capsule, said integral component comprising a capacitor, an insulating layer, a resistor comprising a ceramic layer disposed on said insulating layer and a fuse comprised of a metal layer disposed on said insulating layer.

* * * * *